US008696531B1

(12) United States Patent
Spiller

(10) Patent No.: US 8,696,531 B1
(45) Date of Patent: Apr. 15, 2014

(54) EXERCISE FURNITURE

(75) Inventor: Elizabeth McElvy Spiller, Tuscaloosa, AL (US)

(73) Assignee: Elizabeth McElvy Spiller, Tuscaloosa, AL (US)

( * ) Notice: Subject to any disclaimer, the term of this patent is extended or adjusted under 35 U.S.C. 154(b) by 294 days.

(21) Appl. No.: 12/833,757

(22) Filed: Jul. 9, 2010

Related U.S. Application Data

(60) Provisional application No. 61/270,494, filed on Jul. 9, 2009, provisional application No. 61/279,944, filed on Oct. 28, 2009.

(51) Int. Cl.
*A63B 21/04* (2006.01)
*A63B 21/00* (2006.01)
*A63B 26/00* (2006.01)

(52) U.S. Cl.
USPC ..... 482/130; 482/129; 482/133; 482/142; 482/904

(58) Field of Classification Search
USPC ..... 482/51–52, 62, 91–92, 121–126, 482/129–130, 133–134, 142, 904; D21/662, 686, 690–693
See application file for complete search history.

(56) References Cited

U.S. PATENT DOCUMENTS 1,973,945 A * 9/1934 Chavin et al. ..... 482/130
3,738,649 A * 6/1973 Miller ..... 482/57
4,913,423 A 4/1990 Farran et al.
5,324,243 A * 6/1994 Wilkinson ..... 482/92
5,599,260 A 2/1997 Rovinsky et al.
5,813,947 A 9/1998 Densmore
6,013,014 A * 1/2000 Hern ..... 482/121
6,117,056 A * 9/2000 Cataldi et al. ..... 482/121
6,146,316 A 11/2000 Carolus et al.
6,245,001 B1 * 6/2001 Siaperas ..... 482/142
6,368,260 B1 * 4/2002 Crews ..... 482/142
6,685,605 B1 2/2004 Klossner
6,908,417 B2 * 6/2005 Jackson ..... 482/52
6,929,588 B2 8/2005 Hobson
7,381,168 B2 * 6/2008 Bowser ..... 482/121

(Continued)

OTHER PUBLICATIONS

Sit Strong Systems, "Sit Strong Systems—Fitness in Comfort," http://www.sitstrongsystems.com/fitness/exercises/index.php, Jul. 9, 2010.

*Primary Examiner* — Oren Ginsberg
(74) *Attorney, Agent, or Firm* — Maynard, Cooper & Gale, P.C.; Jon Holland

(57) ABSTRACT

The present disclosure generally pertains to furniture that facilitates the performance of various exercises. In one exemplary embodiment, an article of furniture, such as a chair, a sofa, a love seat, a table, a desk, a dresser, an ottoman, a trunk, or a chest, for example, is used to perform various exercises. The article of furniture has at least one attachment device, such as a hook or handle, to which an exercise band is coupled. The exercise band is elastic and can be pulled by a user to perform one or more exercises. The exercise band deforms when pulled and resists the pulling motion of the user as it is being stretched. In addition, when deformed, the exercise band generates a force that tends to return the band to its pre-deformation shape. By countering the force generated by the exercise band, the user's muscles are strengthened and toned. After performing one or more exercises, the user can remove the exercise band from the attachment device and store the exercise band as may be desired until the next exercise session, and the article of furniture serves as a home or office furnishing.

21 Claims, 12 Drawing Sheets

(56) References Cited

U.S. PATENT DOCUMENTS

| | | | | |
|---|---|---|---|---|
| 7,488,278 | B2 | 2/2009 | Zhang | |
| 7,699,762 | B2 * | 4/2010 | Turnbull et al. | 482/130 |
| 2002/0043909 | A1 | 4/2002 | Nielsen | |
| 2004/0176215 | A1 | 9/2004 | Gramaccioni | |
| 2005/0164855 | A1 | 7/2005 | Li et al. | |
| 2006/0258517 | A1 | 11/2006 | Ashley | |
| 2006/0281607 | A1 | 12/2006 | Hageberg | |
| 2008/0015095 | A1 | 1/2008 | Sausek et al. | |
| 2008/0070763 | A1 | 3/2008 | Greene | |
| 2008/0146422 | A1 * | 6/2008 | Bae | 482/130 |
| 2008/0272628 | A1 | 11/2008 | Lazar | |
| 2009/0108648 | A1 | 4/2009 | Biggs et al. | |

* cited by examiner (Bottom View)

(Top View)

(Side View)

(Bottom View)

(Top View)

EXERCISE FURNITURE

CROSS REFERENCE TO RELATED APPLICATION

This application claims priority to U.S. Provisional Patent Application No. 61/270,494, entitled "Exercise Furniture" and filed on Jul. 9, 2009, which is incorporated herein by reference. This application also claims priority to U.S. Provisional Patent Application No. 61/279,944, entitled "Exercise Furniture" and filed on Oct. 28, 2009, which is incorporated herein by reference.

RELATED ART

Articles of furniture, such as chairs, have been developed that have integrated exercise equipment, such as cables that can be pulled by a user for exercise purposes. However, the designs of many such articles are relatively complicated increasing the articles' overall costs. Further, hiding the cables and/or handles coupled to the cables of such an article can be problematic when the article is not in use for exercising. Further, compartments for housing components of the exercise equipment may be noticeable when the article is not in use for exercising thereby degrading the attractiveness of the article.

BRIEF DESCRIPTION OF THE DRAWINGS

The disclosure can be better understood with reference to at least the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 8 depicts an exemplary embodiment of an exercise band that may be used with an article of exercise furniture, such as is depicted by FIG. 1.

DETAILED DESCRIPTION

The present disclosure generally pertains to furniture that facilitates the performance of various exercises. In one exemplary embodiment, an article of furniture, such as a chair, a sofa, a love seat, a table, a desk, a dresser, an ottoman, a trunk, or a chest, for example, is used to perform various exercises. The article of furniture has at least one attachment device, such as a hook or handle, to which an exercise band is coupled. The exercise band is elastic and can be pulled by a user to perform one or more exercises. The exercise band deforms when pulled and resists the pulling motion of the user as it is being stretched. In addition, when deformed, the exercise band generates a force that tends to return the band to its pre-deformation shape. By countering the force generated by the exercise band, the user's muscles are strengthened and toned. After performing one or more exercises, the user can remove the exercise band from the attachment device and store the exercise band as may be desired until the next exercise session, and the article of furniture serves as a home or office furnishing.

Figure 1:
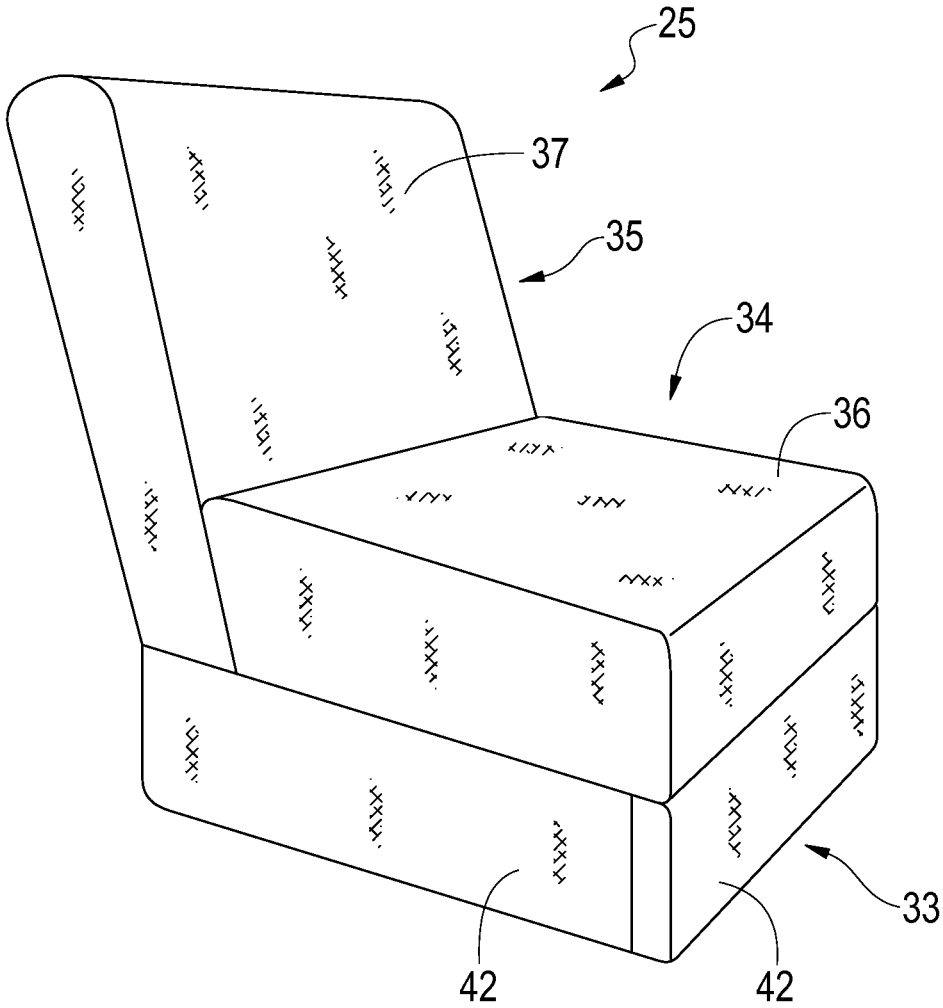
FIG. 1 depicts an exemplary embodiment of an article of exercise furniture.

FIG. 1 depicts an exemplary embodiment of an article 25 of exercise furniture. In the exemplary embodiment shown by FIG. 1, the article 25 is a non-reclining chair, but other types of furniture articles may be employed in other embodiments. For example, in other embodiments, the article 25 may comprise a reclining chair (a "recliner"), a sofa, a love seat, a table, a dresser, an ottoman, a trunk, a chest, or other types of furniture. In the exemplary embodiment shown by FIG. 1, the article 25 of furniture comprises a base 33, a seat 34, and a back 35, which is mounted on the base 33. The seat 34 comprises a cushion 36, and the back 35 comprises a cushion 37. A user may sit or otherwise rest on the article 25 as may be desired. In addition, as will be described in more detail hereafter, a user may utilize the article 25 to perform one or more exercises. Thus, the article 25 serves a dual purpose. In particular, the article 25 provides a home or office furnishing that can be used for sitting, lying, or lounging, and the article 25 provides an exercise station at which the user may perform exercises. Further, when desired, the components used for exercising can be easily hidden so that the system's use as an exercise station is not readily apparent to a casual observer.

Figure 2:
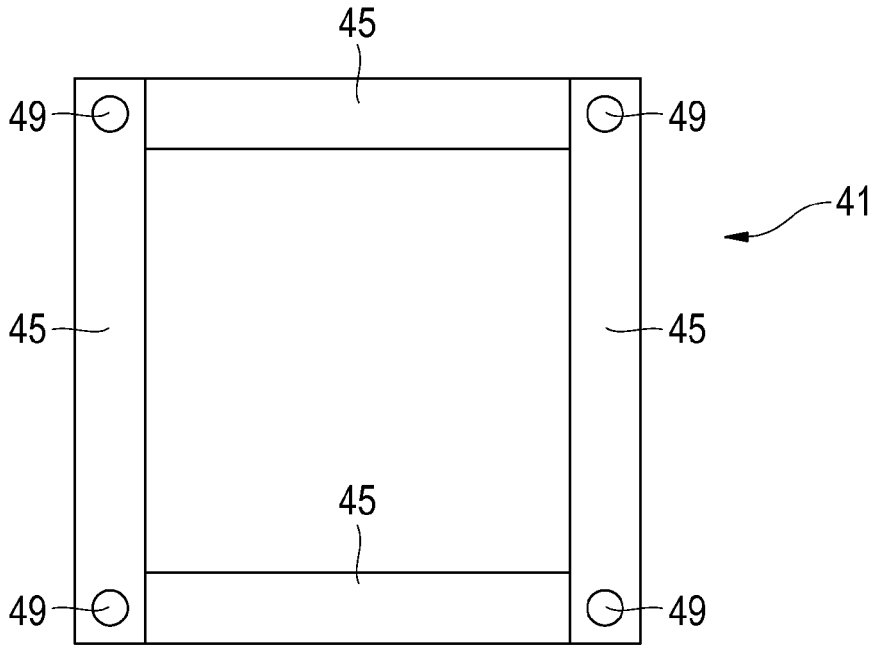
FIG. 2 is a bottom view illustrating an exemplary embodiment of a frame for an article of exercise furniture, such as is depicted by FIG. 1.

The base 33 comprises a frame 41, such as is depicted by FIG. 2 that is covered by fabric 42. Note that the fabric 42 is not shown in FIG. 4 for illustrative purposes. The frame 41 comprises a plurality of lower support elements 45 that are coupled to one another. In one exemplary embodiment, each lower support element 45 comprises a beam of wood or some other material, and FIG. 2 shows four lower support elements 45 that are coupled together end-to-end. Nails (not shown) or other types of couplers, such as screws, may be used to couple the lower support elements 45 to each other. Further, the lower support elements 45 are positioned orthogonally with respect to each other such that the lower support elements 45 form a square or rectangle, but other shapes and configurations are possible in other embodiments.

In addition, a plurality of legs 49 are coupled to the lower support elements 45 such that the frame 41 is positioned above the floor with a space between the frame 41 and the floor when the article 25 is positioned upright as shown by FIG. 1. In FIG. 1, each of the legs 49 contacts the floor, and the frame 41 rests on the legs 49.

Figure 3:
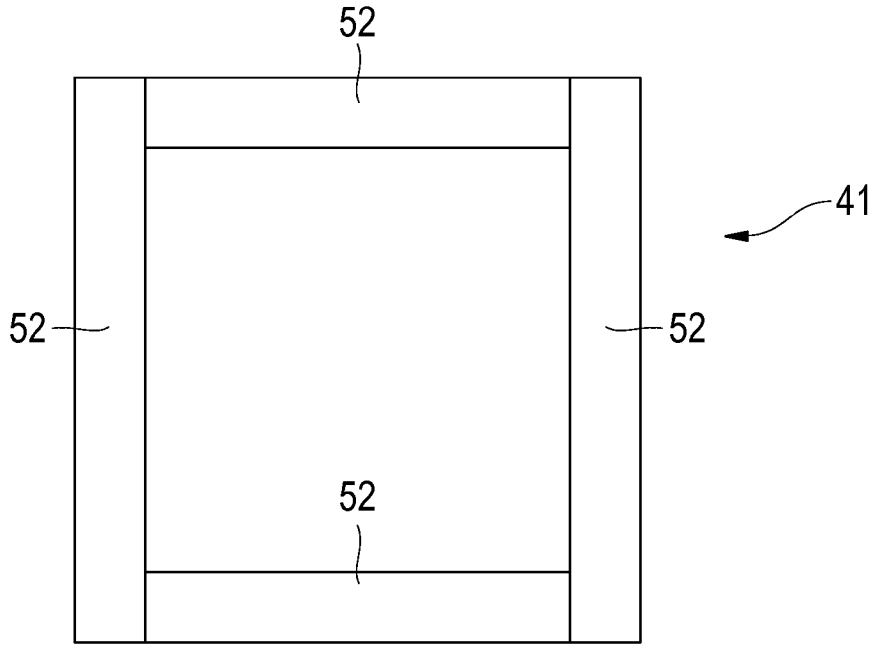
FIG. 3 is a top view of the frame depicted by FIG. 2.

As shown by FIG. 3, the frame 41 also comprises a plurality of upper support elements 52 that are coupled to one another. In one exemplary embodiment, the dimensions of and the configuration of the upper support elements 52 are identical to those of the lower support elements 45, but variations in such dimensions or configurations are possible. The cushion 37 is mounted or otherwise positioned on at least one of the upper support elements 52, and the seat cushion 36 rests on the arrangement of the upper support element 52. However, the seat cushion 36 can be lifted off of the upper support elements 52 by hand or otherwise if desired.

Figure 4:
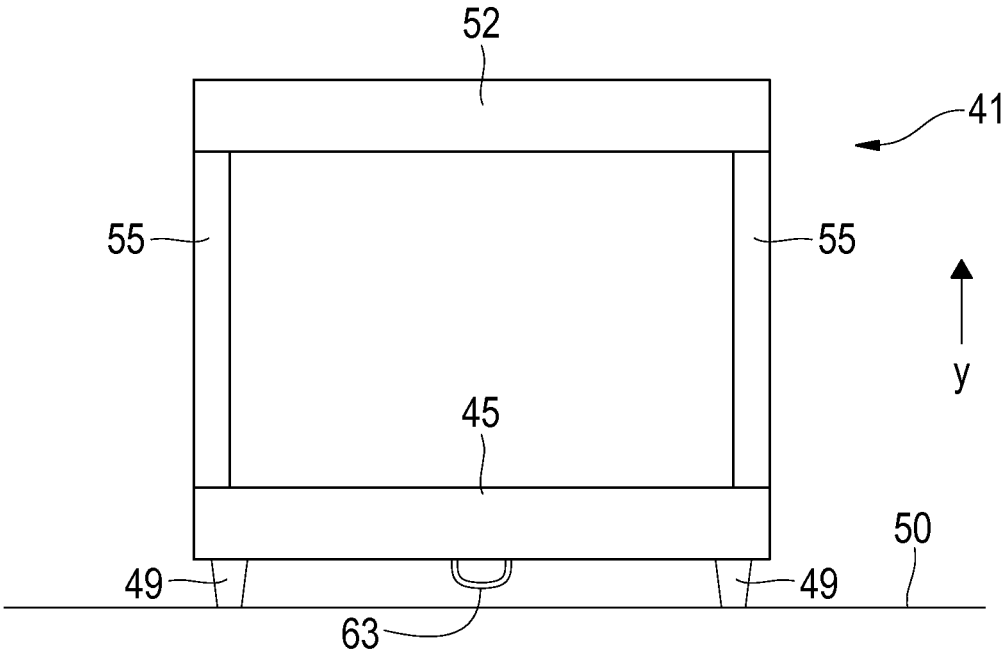
FIG. 4 is a side view of the frame depicted by FIG. 2.

As shown by FIG. 4, the arrangement of lower support elements 45 is coupled to the arrangement of upper support elements 52 by a plurality of support elements 55, referred to hereafter as "posts." In one exemplary embodiment, a respective post 55 is positioned at each corner of the arrangement of lower support elements 45 and the arrangement of upper support elements 52. That is, each respective post 55 couples a corner of the arrangement of lower support elements 45 to a corner of the arrangement of upper support elements 52. Thus, there are four total posts 55 (one for each corner). Further, each post 55 comprises a beam of wood or some other material. However, other numbers and types of posts 55 are possible in other embodiments.

In one exemplary embodiment, the height (in the y-direction) of the attachment device 63 from the lower support element 45 to which it is coupled is less than the height of the legs 49, as shown by FIG. 4, such that the attachment apparatus 63 does not contact a floor 50 when the legs 49 are positioned on and contacting the floor 50.

Figure 5:
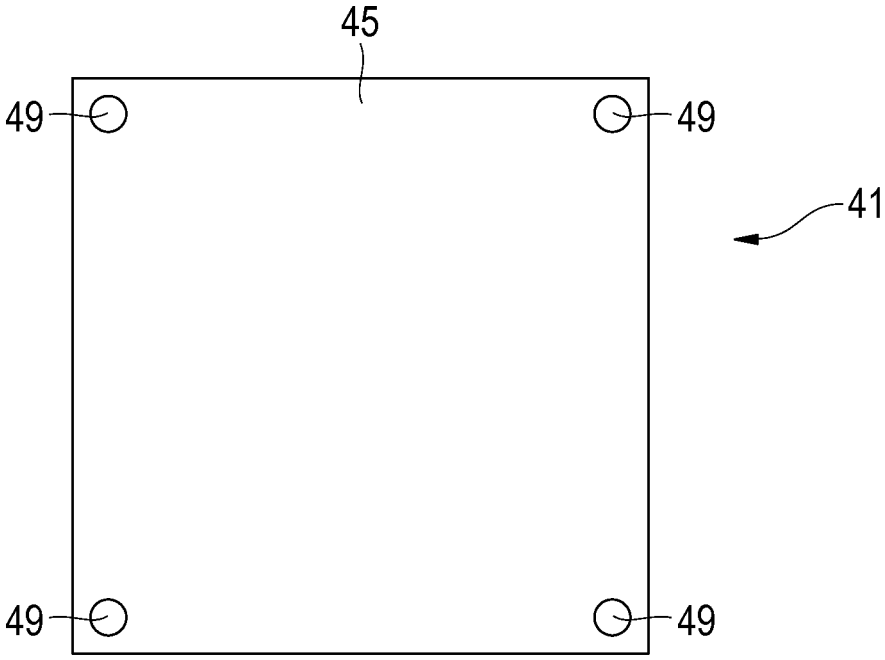
FIG. 5 is a bottom view illustrating an exemplary embodiment of a frame for an article of exercise furniture, such as is depicted by FIG. 1.

It should be noted that the configuration of the frame 41 described above and shown by FIGS. 2-4 is exemplary. In other embodiments, other configurations of the frame 41 are possible. In particular, other numbers and types of the lower support elements 45, upper support elements 52, and/or posts 55 are possible in other embodiments. As a mere example, as shown by FIG. 5, a single lower support element 45 may be used instead of the plurality of support elements 45 shown by FIG. 2. In such an embodiment, the lower support element 45 may comprise a panel of wood or some other material. Similarly, a panel of wood or some other material may be used instead of the arrangement of upper support elements 52 shown by FIG. 3. Alternatively, to provide better support for the cushion 36 and a user sitting on the cushion 36, a panel of wood or some other material may be positioned on the arrangement of upper support elements 52. Yet other configurations of the frame 41 are possible in other embodiments.

Figure 6:
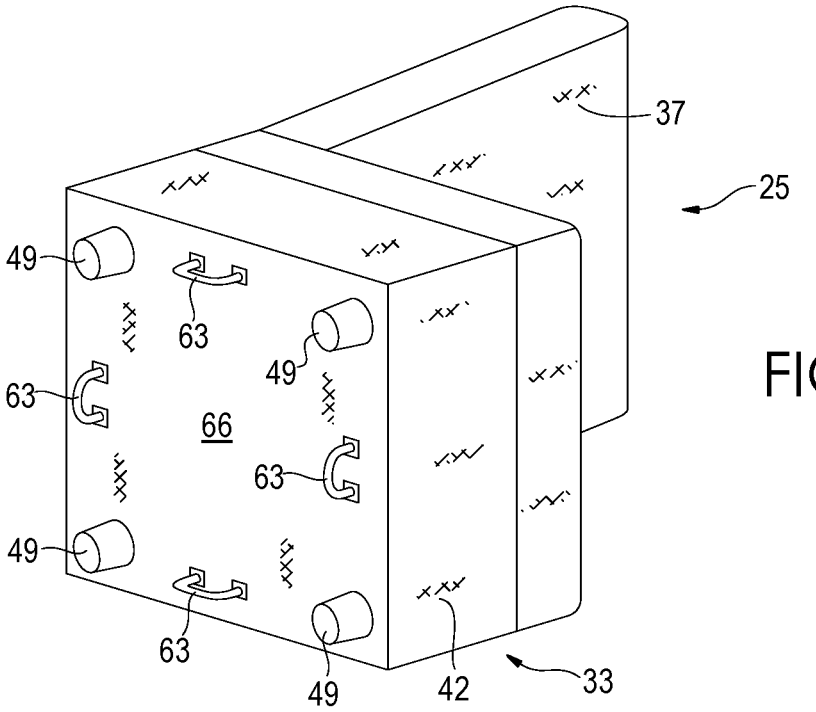
FIG. 6 depicts the article of exercise furniture depicted by FIG. 1 after the article has been turned on its side.
Figure 8:
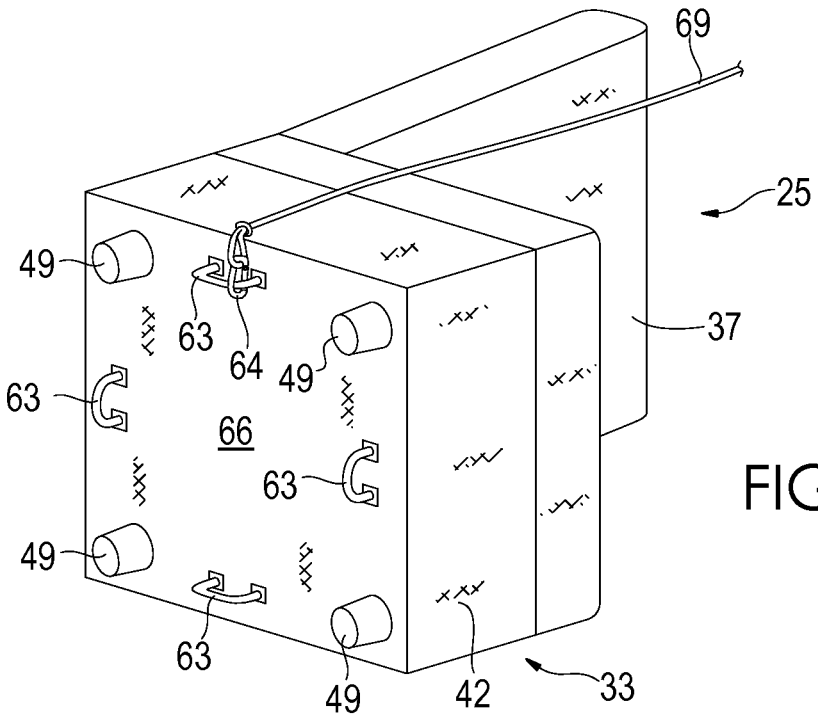
FIG. 8 depicts the article of exercise furniture depicted by FIG. 1 after an exercise band has been coupled to an attachment device of the article via a carabiner.

As shown by FIG. 6, a plurality of attachment devices 63 are coupled to the lower support elements 45, which are hidden in FIG. 6 by a covering 66 that is stapled or otherwise attached to the support elements 45. Each attachment device 63 comprises a handle, a loop, a hook, or other like device to which an elastic exercise band 69 can be detachably coupled. For example, in one embodiment, the exercise band 69 is tied to an attachment device 63. In another embodiment, the exercise band 69 is secured to a carabiner 64 (e.g., a D-ring), which can be detachably coupled to the attachment device 63, as shown by FIG. 8. Yet other techniques for detachably coupling the exercise band 69 to an attachment device 63 are possible in other embodiments.

In one exemplary embodiment, each support element 45 of the frame 41 on which an attachment device is directly mounted is composed of plywood and is at least an inch thick (in the y-direction of FIG. 4) in order to ensure that the support element 45 has sufficient mechanical strength to support and accommodate the exercises contemplated herein for some embodiments, as will be described in more detail hereafter. However, other dimensions and other materials for such support element 45 are possible in other embodiments.

Figure 7:
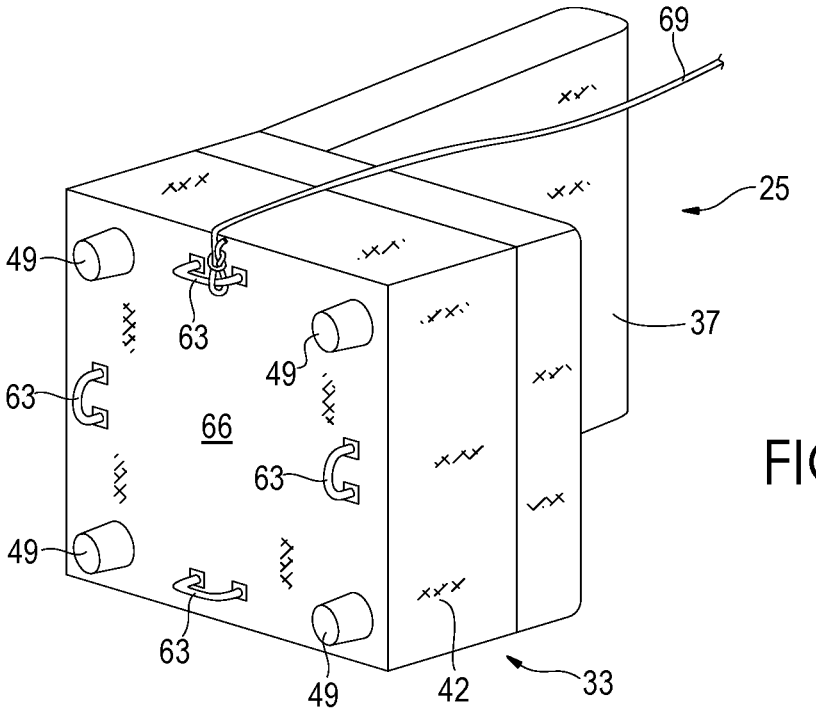
FIG. 7 depicts the article of exercise furniture depicted by FIG. 1 after an exercise band has been tied to an attachment device of the article.
Figure 9:
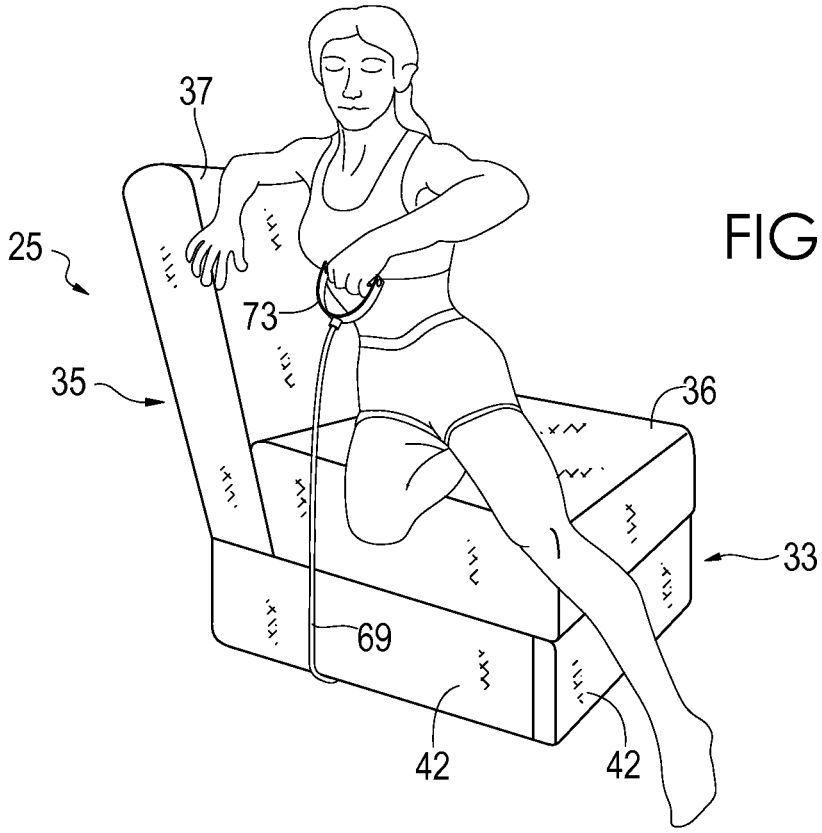
FIG. 9 depicts the article of exercise furniture depicted by FIG. 7 in use for performing exercises.

In the exemplary embodiment shown by FIGS. 7 and 9, one end of the exercise band 69 is secured to an attachment device 63 of the article 25, and the other end of the exercise band 69 is secured to a handle 73 that can be gripped by a user. However, in other embodiments, a handle 73 is not used. For example, the exercise band 69 may form a loop. Such a band 69 may be tied or otherwise coupled to an attachment device 63, and a user may grip the band 69 directly to perform an exercise.

The exercise band 69 is preferably elastic such that it can be stretched by a user and provide resistance for the user as the band 69 is being stretch. In one exemplary embodiment, the exercise band 69 is composed of rubber but other materials are possible in other embodiments. The band 69 can be used to perform one or more exercises as may be desired. For example, FIG. 9 shows the article 25 being used to perform an exercise. In this regard, a user is sitting on the cushion 36, and the weight of the user helps to keep the article 25 in place as she pulls on an exercise band 69. By pulling on the band 69, the user stretches the band 69, and the deformation of the band 69 generates an elastic force that counteracts the force being applied by the user helping to strengthen the user's muscles that are used in the pulling motion. The elastic force tends to force the band 69 back to its original position prior to stretching as the user reduces the force applied to the band 69. Thus, the user can repetitively stretch the band 69 and then allow the band 69 to return to its original non-stretched state in performing an exercise routine to help strengthen the user's muscles and/or otherwise improve the health of the user.

In the exemplary embodiment shown by FIG. 9, the article 25 does not have any armrests, which might interfere with at least some of the exercises that the user may desire to perform, but the article 25 may have armrests in other embodiments. Further, each of the cushions 36 and 37 is composed of foam having relatively firm properties to help provide support to the user during exercising. In one exemplary embodiment, each cushion 36 and 37 is composed of a foam having a density of about 6 to 12 pounds (lbs) per cubic foot and an indentation load deflection (ILD) of about 30 to 60 pounds. However, other densities and ILDs are possible in other embodiments.

Figure 10:
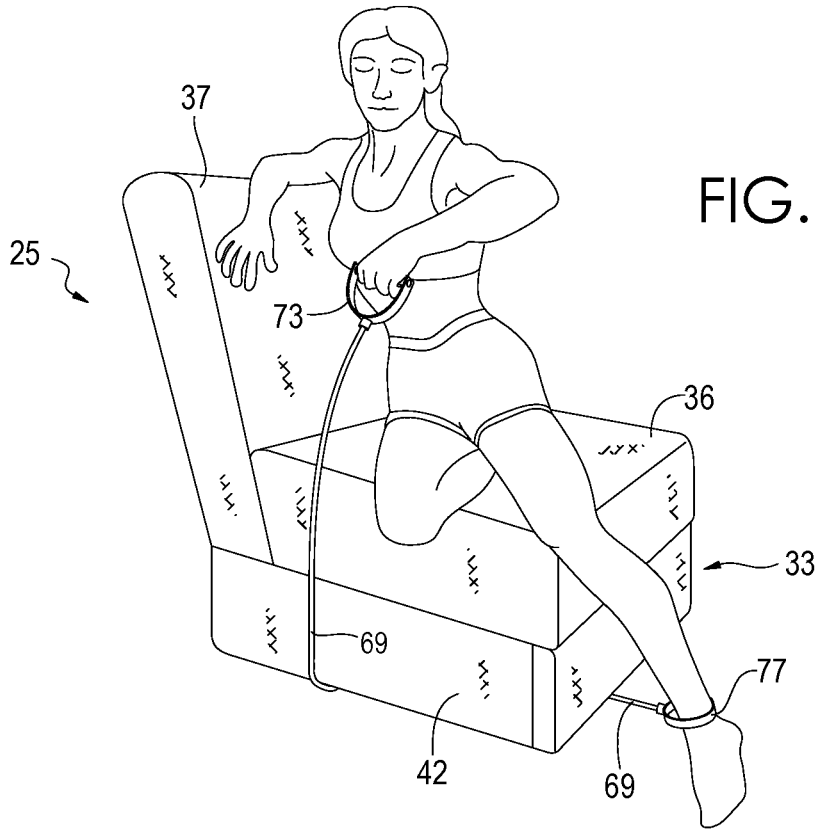
FIG. 10 depicts the article of exercise furniture depicted by FIG. 7 in use for performing exercises after a second exercise band has been coupled to the article.

Having multiple attachment devices 63 at multiple positions provides the user with greater flexibility in the types of exercises that can be performed and the positions of the user during exercising. For example, in the embodiment shown by FIG. 10, a user utilizes two exercise bands 69 that are coupled to different attachment devices 63. In this regard, the user grips one exercise band 69, which is coupled to one attachment device 63, with her hand and pulls on this exercise band 69 thereby, strengthening predominantly her upper body. Simultaneously, the user pulls on another exercise band 69, which is coupled to a different attachment device 63, with her leg thereby strengthening predominantly her lower body. In this regard, this other exercise band 69 is coupled to an ankle brace 77 that is wrapped around the leg or ankle of the user. In one exemplary embodiment, the ankle brace 77 has Velcro to help secure the brace 77 to the user's leg or ankle, but other types of ankle or leg braces are possible. Note that the exercise band 69 grasped by the user's hand in FIG. 10 is of a type that forms a loop, and the exercise band 69 coupled to the user's leg has two ends (one coupled to an attachment device 63 and another coupled to the ankle brace 77).

As shown by FIG. 6, an attachment device 63 is located on each side of the article 25. In this regard, an attachment device 63 is coupled to each of the lower support elements 45, and there are four attachment devices 63 shown. However, in other embodiments, other numbers and positions of the attachment devices 63 are possible.

Once the user has finished using an exercise band 69 for a given exercise session, the user can detach (e.g., untie) the band 69 from the attachment device 63 to which it was coupled during the exercise session thereby removing the band 69 from the article 25. Thus, the article 25 may be observed without viewing the exercise band 69, which may otherwise appear unsightly. Indeed, the observer may be unaware that the article 25 even provides an exercise station such that the functionality of the article 25 as an exercise station is hidden from the observer.

Figure 11:
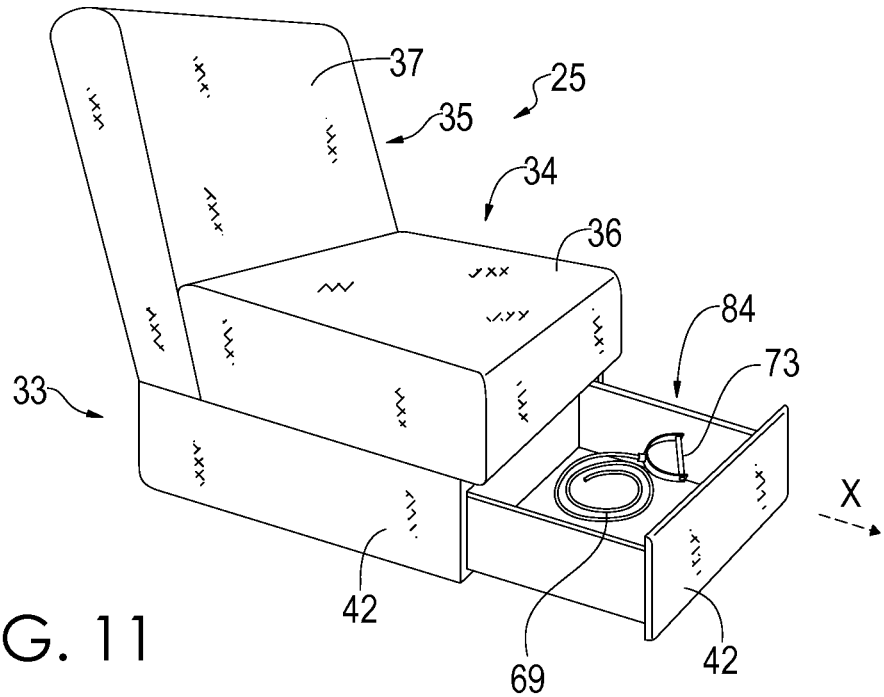
FIG. 11 depicts the article of exercise furniture depicted by FIG. 1 after a compartment of the article has been opened.

In one exemplary embodiment, the article 25 has a compartment in which an exercise band 69 removed from an attachment device 63 may be stored and hidden from view. For example, in one embodiment, the article 25 has a drawer 84 that can be opened, as shown by FIG. 11, to store an exercise band 69 removed from the article 25. The drawer 84 is movable back and forth in the x-direction so that the drawer 84 can be moved from a closed position, as shown in FIG. 10, to an open position, as shown in FIG. 11. The drawer 84 is located between and slides through a pair of posts 55 (FIG. 4) of the frame 41. The user may move the drawer 84 to the open position shown by FIG. 11 and insert an exercise band 69 or other object, such as a piece of equipment used during exercising. The user may then move the drawer 84 to the closed position shown by FIG. 10 to hide the objects placed in the drawer 84.

By being located underneath the article 25, the attachment devices 63 are substantially hidden from view. Thus, when the bands 69 are removed from the article 25, it is not readily apparent that the article 25 provides an exercise station. In addition, the underside of the article 25 is easily accessible for attaching and removing exercise bands 69 to and from the attachment devices 63 by turning the article 25 on its side, as shown by FIG. 7, or upside down. However, if desired, an exercise band 69 may be coupled to and/or detached from an attachment device 63 while the article 25 is upright and resting on the legs 49. In addition, the exercise band 69, when coupled to an attachment device 63 does not pass through the article 25 but rather is external to the article 25 facilitating removal of the band 69 from the article 25. However, in other embodiments, it is possible for the band 69 to pass through the article 25, if desired.

As indicated above, various configurations of the attachment devices 63 are possible. In one exemplary embodiment, each attachment device 63 comprises a quarter-inch threaded T-nut, but other types of devices and other sizes are possible in other embodiments. The T-nut forms a loop or hook that can be coupled to an exercise band 69.

Figure 12:
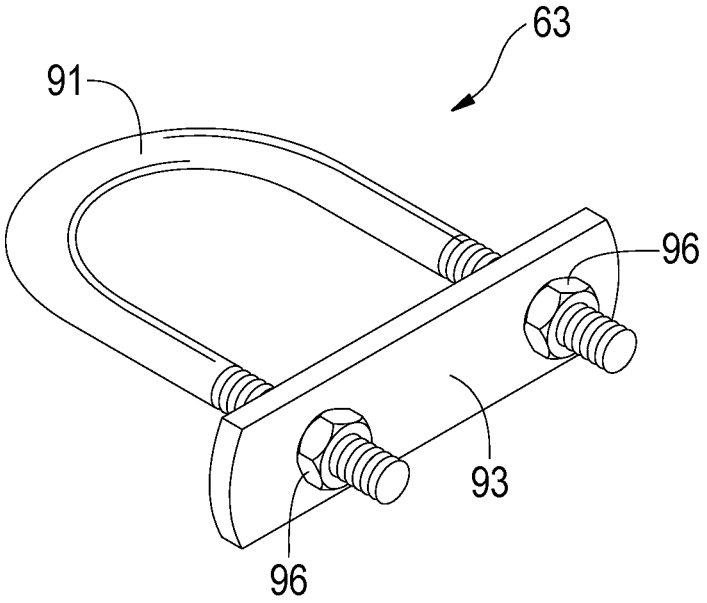
FIG. 12 depicts an exemplary embodiment of an attachment device for an article of exercise furniture, such as is depicted by FIG. 1.
Figure 13:
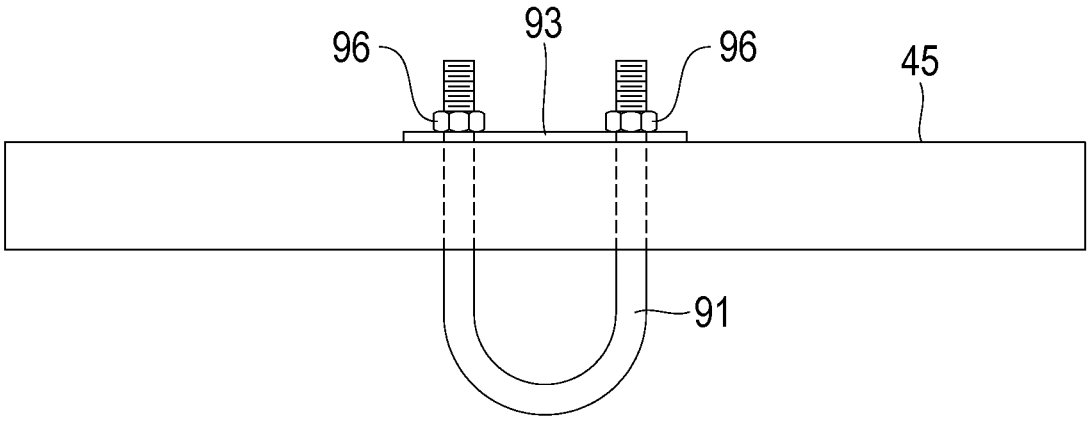
FIG. 13 depicts the attachment device of FIG. 12 coupled to a support element of an article of exercise furniture, such as is depicted by FIG. 1.

FIG. 12 depicts an exemplary embodiment of an attachment device 63. The attachment device 63 of FIG. 12 has a U-shaped bolt 91 that is threaded at each end. Further, each end of the bolt 91 passes through a plate 93 and a respective nut 96. FIG. 13 shows the attachment device 63 of FIG. 12 coupled to a lower support element 45. The bolt 91 passes through a pair of holes in the lower support element 45. Further, each nut 96 is tightened such that it presses the plate 93 against the lower support element 45 helping to secure the attachment device 63 to the lower support element 45. An exercise band 69 may be tied or otherwise coupled to the bolt 91 so that the band 69 may be used to perform an exercise as described herein. Other types of couplers, such at T-nuts may be used to implement the attachment device 63 in other embodiments.

Figure 14:
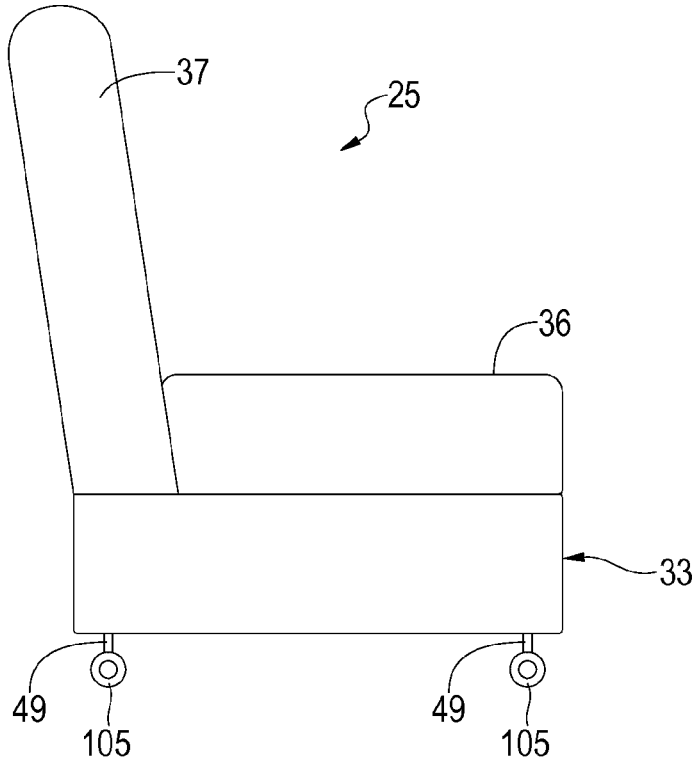
FIG. 14 depicts an exemplary embodiment of an article of exercise furniture that has rolling apparatuses for facilitating movement of the article.

In one exemplary embodiment, the article 25 has legs 49 that are coupled to rolling apparatuses 105, such as wheels or rollers, as shown by FIG. 14, to facilitate movement of the article 25 across a floor. In this regard, a user may push the article 25 such that the rolling apparatuses 105 rotate allowing the article 25 to roll. For example, the user may push the article 25 to a desired location to perform an exercise routine and then push the article 25 back to its original position after performing the exercise routine. In one exemplary embodiment, each leg 49 is coupled to a respect rolling apparatus 105. However, if desired, less than all of the legs 49 may be coupled to a respective rolling apparatus 105. For example, two of the legs 49 may each be coupled to a respective rolling apparatus 105, and a user may tilt the article 25 while rolling it across the floor.

Various types of rolling apparatuses 105 may be used. For example, a rolling apparatus 105 may be shaped as a sphere that is rotatably mounted on a leg 49. Alternatively, a rolling apparatus 105 may be shaped as a doughnut or a cylinder that is rotatably mounted on a leg 49. Yet other shapes are possible in other embodiments. In one exemplary embodiment, each rolling apparatus 105 has a locking mechanism (not shown) that can be used to lock the rolling apparatus 105 such that rotation can be prevented. When the article 25 is to be moved, the user may unlock the locking mechanism such that rotation of the rolling apparatus 105 is permitted. After the article 25 has been moved to its desired location, the user may lock the locking mechanism such that rotation of the rotating apparatus 105 is prevented. Locking the locking mechanism may be particularly beneficial when the user is performing exercises to help prevent the article 25 from sliding out from under the user or otherwise moving as he or she is sitting, lying, and/or applying forces to the article 25 via an exercise band 69 or otherwise. There are various known rolling apparatuses that have locking mechanisms to allow selective rotation of the rolling apparatuses. Any such conventional rolling apparatus may be used to implement the rolling apparatuses 105 of the article 25.

Figure 15:
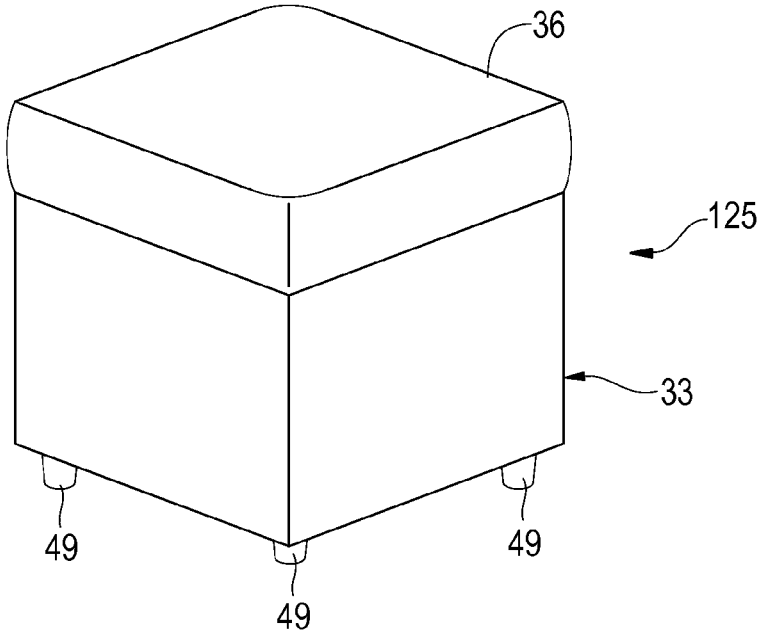
FIG. 15 depicts an exemplary embodiment of an article of exercise furniture.

FIG. 15 depicts an exemplary embodiment of an article 125 of exercise furniture, which is implemented as an ottoman. Similar to the article 25 of FIG. 1, the article 125 shown by FIG. 15 has a base 33, a plurality of legs 49, and a cushion 36 that rests on the base 33. Further, the base 33 has a frame (not shown in FIG. 15) that may be similar to the frame 41 depicted by FIGS. 2-4. However, the dimensions of the article 125 of FIG. 15 may be different than those for the article 25 of FIG. 1.

Figure 16:
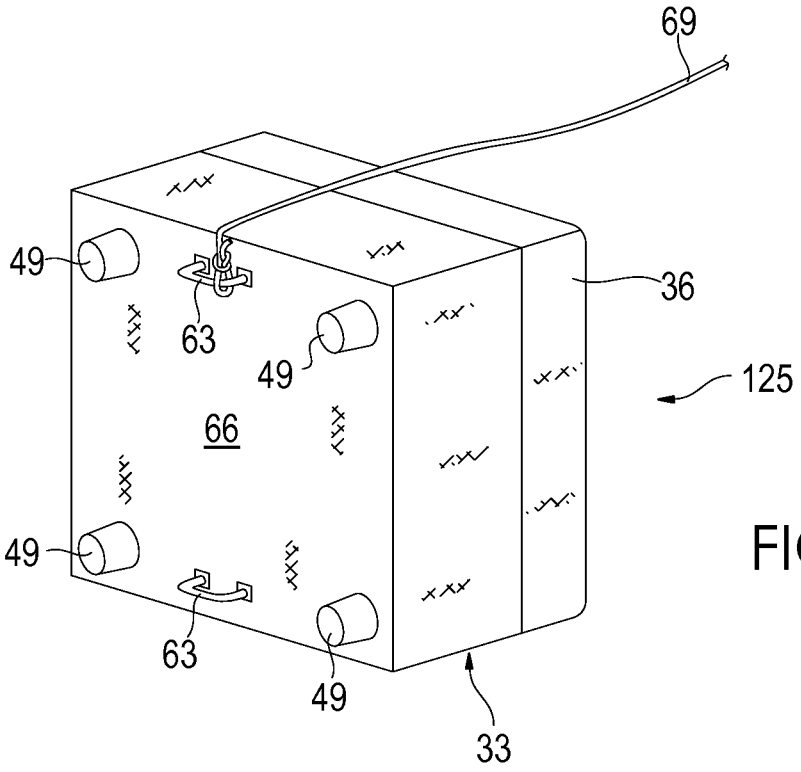
FIG. 16 depicts the article of exercise furniture depicted by FIG. 15 after the article has been turned on its side.
Figure 17:
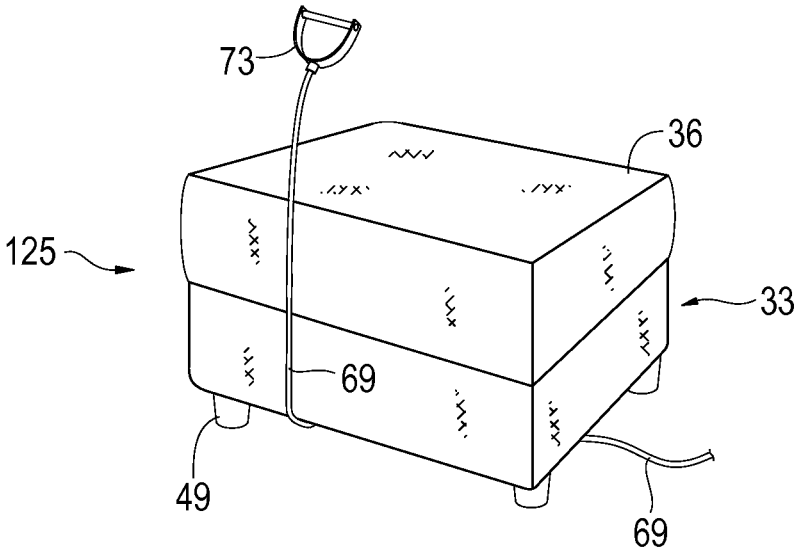
FIG. 17 depicts the article of exercise furniture depicted by FIG. 10 in use for performing exercises.

As shown by FIG. 16, the base 33 of the article 125 has a plurality of attachment devices 63 mounted thereon. The attachment devices 63 are located beneath the article 25 and are substantially hidden from view when the article 125 is in the upright position shown by FIG. 15 such that the article 125 rests on the legs 49. Each attachment device 63 forms a loop to which at least one exercise band 69 may be coupled, as described above for the article 25 of FIG. 1. FIG. 16 shows two attachment devices 63, but other numbers of attachment devices 63 may be used in other embodiments. For example, the article 125 may have four attachment devices 63 (one on each side of the article 125) similar to the article 25 of FIG. 1. As shown by FIG. 17, at least one exercise band 69 may be coupled to at least one attachment device 63 and used to perform exercises in a manner similar to that described above for the article 25 of FIG. 1.

Figure 18:
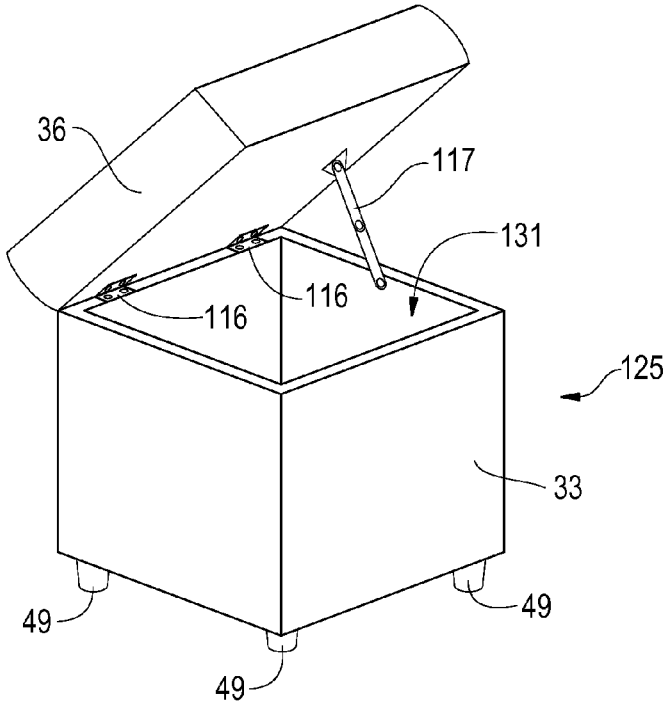
FIG. 18 depicts an article of exercise furniture, such as is depicted by FIG. 15, after a cushion has been rotated to open a compartment of the article.

In one exemplary embodiment, the cushion 36 is mounted on the base 33 by a pair of hinges 116, as shown by FIG. 18. Further, the base 33 is hollow such that it forms a compartment 131 for storing objects, such as exercise equipment (e.g., an exercise band 69). A user may open the compartment 131 by lifting on the cushion 36 such that it pivots about the hinges 116. A locking arm 117 is configured to apply a force on the cushion 36 to keep the cushion in an open position once a user has opened and released the cushion. The cushion 36 may be rotated in the opposite direction about the hinges 116 to close the compartment 131. In this regard, the locking arm 117 is sufficient to withstand the weight of the cushion 36 but does not prevent a user from rotating the cushion 36 by hand or otherwise. In other embodiments, other numbers of hinges 116 may be used, and other types of devices for mounting the cushion 36 on the base 33 are possible. Further, it is unnecessary for the cushion 36 to be mounted on the base 33. For example, the cushion 36 may be removable such that a user can lift the cushion off of the base to open the compartment 131.

Figure 19:
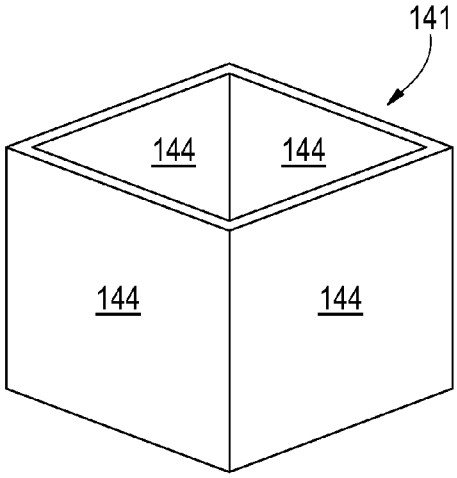
FIG. 19 depicts an exemplary embodiment of a frame for an article of exercise furniture, such as is depicted by FIG. 18.
Figure 20:
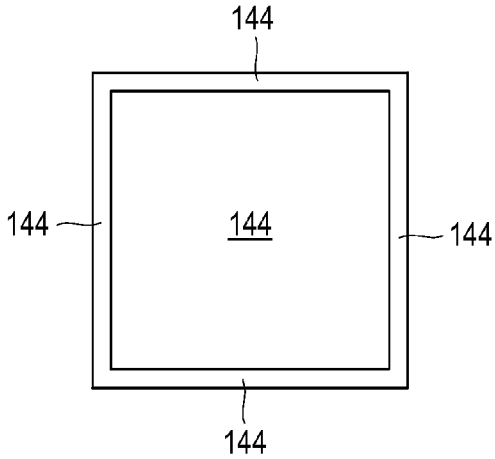
FIG. 20 is a top view illustrating the frame depicted by FIG. 19.

FIGS. 19 and 20 show an exemplary embodiment of a frame 141 for the article 125. The frame 141 comprises five support elements 144, and each support element 144 comprises a panel of wood or some other material in the exemplary embodiment shown by FIGS. 19 and 20. Four of the support elements 144 form the sides of the frame 141, and the remaining support element 144 forms the bottom of the frame 141. The support elements 144 are coupled to each other via nails, glue, or otherwise and are generally orthogonal to one another such that the support elements 144 form a topless box for holding objects. Other configurations of the frame 141 are possible in other embodiments. For example, the support elements 144 may be configured similar to those of the frame 41 depicted by FIGS. 2-4.

Figure 21:
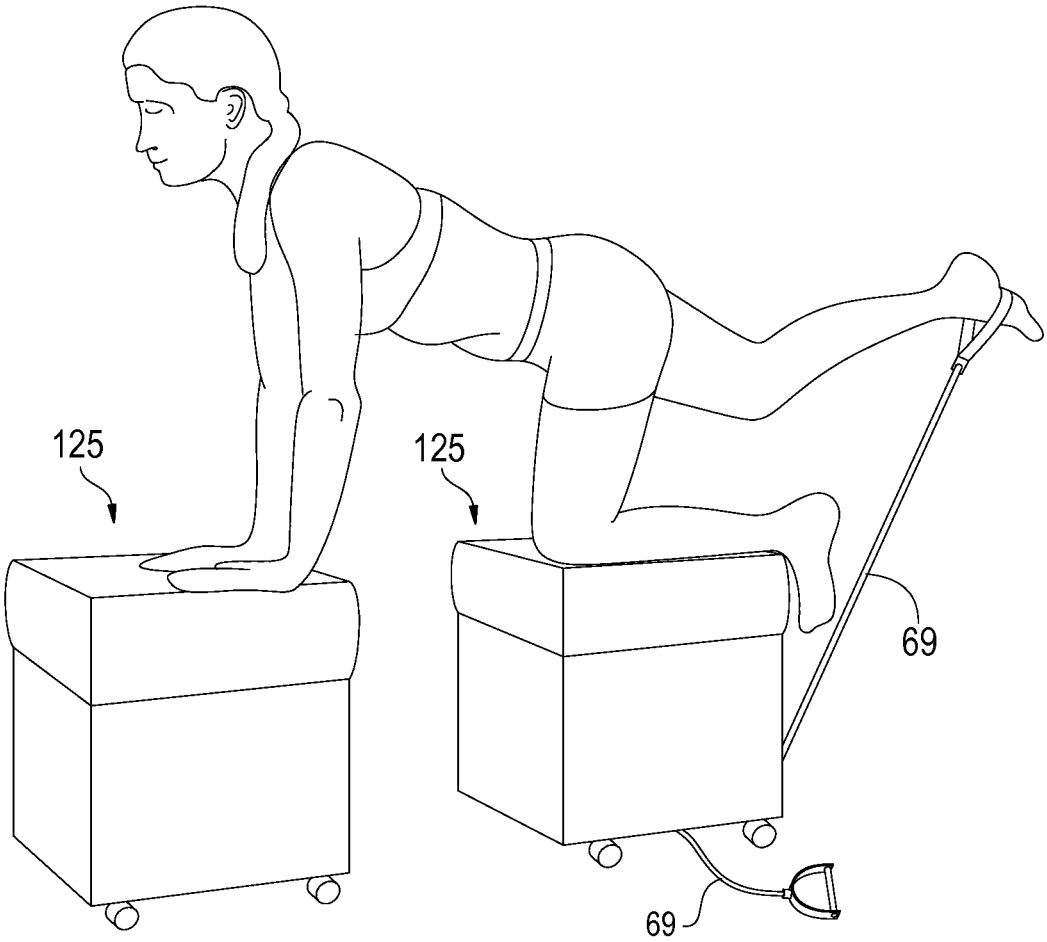
FIG. 21 depicts articles of exercise furniture, such as is depicted by FIG. 15, in use for performing exercises.

As shown by FIG. 21, multiple articles 125 may be simultaneously used to perform various exercises. Utilizing rolling apparatuses 105, as described above, may be beneficial in such an embodiment to facilitate the positioning of one article 125 with respect to another.

In various embodiments described above, an elastic exercise band 69 coupled to attachment devices 63 is used to perform various exercises. However, non-elastic apparatuses may be attached to the attachment device 63 for performing exercises, if desired. Indeed, any type of apparatus may be attached to the attachment devices 63. In one exemplary embodiment, a rope having very little or no elasticity is coupled to at least one attachment device 63 and used to perform at least one exercise.

Figure 22:
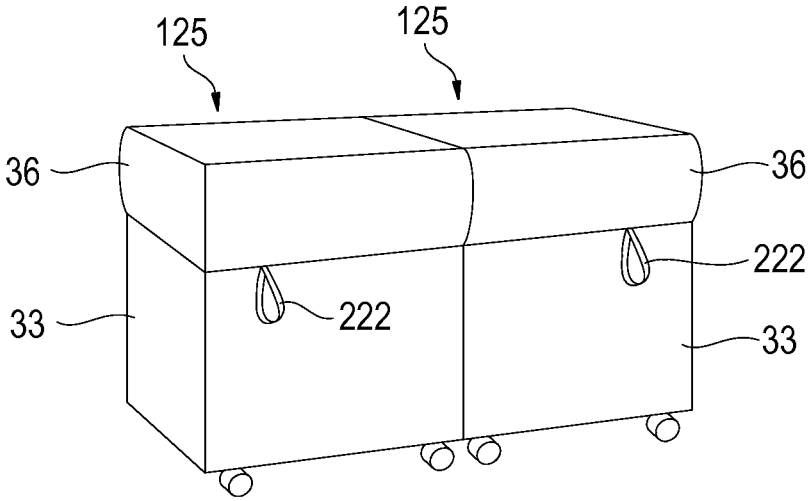
FIG. 22 depicts the articles of exercise furniture depicted by FIG. 21.

In one exemplary embodiment, the attachment devices 63 are composed of a high strength metal, such as aluminum or steel. However, other materials are possible. For example, an attachment device 63 may comprise a flexible strap 222, such as is depicted in FIG. 22. Further, as also shown by FIG. 22, it is unnecessary for an attachment device 63 to be mounted underneath an article of furniture. For example, in FIG. 22, an attachment device 63 is mounted on the top of the base 33. Thus, a portion of the attachment device 63 resides between the cushion 36 and the base 33. During an exercise session, the attachment device 63 may be exposed, as shown by FIG. 22. However, after the session, the attachment device 63 may be pushed under the cushion 36 so that it is hidden. Various other locations of the attachment devices 63 are possible in other embodiments.

Figure 23:
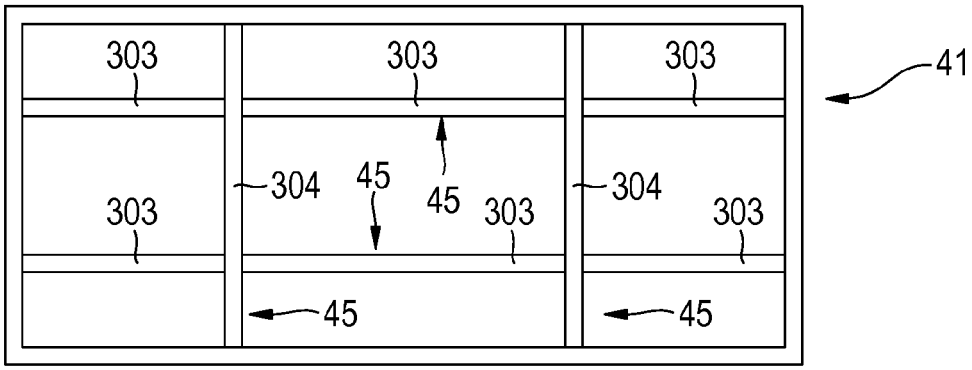
FIG. 23 depicts an exemplary embodiment of a frame for a base of an article of exercise furniture.

FIG. 23 depicts an exemplary embodiment in which each of the lower support elements 45 comprises a bar 303, 304 composed of a high strength material, such as steel, and the bars 303, 304 are interconnected to form a grid. At least one attachment device (not shown in FIG. 23) is coupled to at least one of the bars 303, 304. The exemplary embodiment shown by FIG. 23 has two horizontal bars 303 and two vertical bars 304, which are orthogonal to the horizontal bars 303. Further, each horizontal bar 303 is welded or otherwise coupled to each vertical bar 304, and the bars 303, 304 form a truss for absorbing forces exerted on the attachment device by a user. The arrangement of lower support elements 45 shown by FIG. 23 may provide an article of furniture with a relatively high degree of mechanical integrity.

Figure 24:
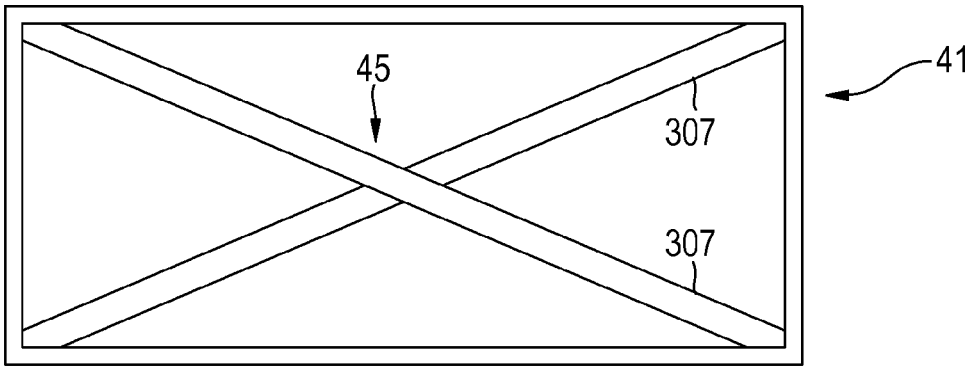
FIG. 24 depicts an exemplary embodiment of a frame for a base of an article of exercise furniture.

Other numbers and configurations of support elements 45 are possible in other embodiments. For example, FIG. 24 shows an exemplary embodiment having a pair of crossed support elements 45 where each support element 45 comprises a bar 307 of high strength material, such as steel. The bars 307 are welded or otherwise coupled to each other. Further, at least one attachment device (not shown in FIG. 24) is coupled to at least one of the bars 307.

Now, therefore, the following is claimed:

1. An article of furniture, comprising:

a base having a first plurality of interconnected beams, including a first beam, a second beam, a third beam, and a fourth beam, wherein the first beam is coupled to and orthogonal to the second beam, wherein the second beam is coupled to and orthogonal to the third beam, wherein the third beam is coupled to and orthogonal to the fourth beam, and wherein the fourth beam is coupled to and orthogonal to the first beam;

a plurality of legs coupled to the first plurality of interconnected beams such that a space exists between a floor and the first plurality of interconnected beams when each of the legs is resting on the floor;

a seat cushion supported by and positioned on the base;

an attachment device coupled to one of the first plurality of interconnected beams such that the attachment device is underneath the base in the space between the floor and the first plurality of interconnected beams when each of the legs is resting on the floor;

fabric for covering the first plurality of interconnected beams; and an exercise band having a first end and a second end opposite of the first end, the first end coupled to the attachment device, wherein a length of the exercise band from the first end to the second end is external to the article of furniture.

2. The article of claim 1, wherein at least one of the legs is coupled to at least one rolling apparatus.

3. The article of claim 1, wherein the attachment device forms a loop.

4. The article of claim 1, wherein the first end of the exercise band is detachably coupled to the attachment device.

5. The article of claim 4, wherein the first end is coupled to a carabiner, and wherein the carabiner is coupled to the attachment device.

6. The article of claim 4, wherein the first end of the exercise band is tied to the attachment device.

7. The article of claim 1, wherein the exercise band is elastic.

8. The article of claim 1, wherein each of the beams is composed of wood.

9. The article of claim 1, wherein the base further comprises at least one upper support element and a plurality of posts, each of the posts coupled to a respective one of the beams and to the at least one upper support element.

10. The article of claim 9, wherein the plurality of posts include at least a first post, a second post, a third post, and a fourth post, wherein the first post is positioned at a first corner of the base, wherein the second post is positioned at a second corner of the base, wherein the third post is positioned at a third corner of the base, and wherein the fourth post is positioned at a fourth corner of the base.

11. The article of claim 1, wherein the base further comprises a plurality of posts and a second plurality of interconnected beams, including at least a fifth beam, a sixth beam, a seventh beam, and an eighth beam, wherein the fifth beam is coupled to and orthogonal to the sixth beam, wherein the sixth beam is coupled to and orthogonal to the seventh beam, wherein the seventh beam is coupled to and orthogonal to the eighth beam, and wherein the eighth beam is coupled to and orthogonal to the fifth beam, and wherein the first plurality of interconnected beams is coupled to the second plurality of interconnected beams via the plurality of posts.

12. The article of claim 11, wherein the plurality of posts include at least a first post, a second post, a third post, and a fourth post, wherein the first post is positioned at a first corner of the base, wherein the second post is positioned at a second corner of the base, wherein the third post is positioned at a third corner of the base, and wherein the fourth post is positioned at a fourth corner of the base.

13. The article of claim 1, further comprising a back mounted on the base.

14. The article of claim 1, wherein the seat cushion comprises foam having a density between at least 6 pounds per cubic foot and an indentation load deflection of at least 30 pounds.

15. A method, comprising the steps of:

coupling an exercise band to an attachment device of an article of furniture, the article having a base, fabric, and a seat cushion supported by the base, the base having a plurality of interconnected beams, including a first beam, a second beam, a third beam, and a fourth beam, wherein the first beam is coupled to and orthogonal to the second beam, wherein the second beam is coupled to and orthogonal to the third beam, wherein the third beam is coupled to and orthogonal to the fourth beam, and wherein the fourth beam is coupled to and orthogonal to the first beam, wherein the attachment device is coupled to one of the plurality of interconnected beams, and wherein the fabric covers the plurality of interconnected beams;

positioning the article such that a plurality of legs of the article rest on a floor while the attachment device is between the base and the floor; and pulling the exercise band while the exercise band is coupled to the attachment device and is entirely external to the article of furniture.

16. The method of claim 15, wherein the attachment device forms a loop.

17. The method of claim 16, wherein the coupling step comprises the step of detachably coupling the exercise band to the attachment device.

18. The method of claim 16, wherein the coupling step comprises the steps of:

coupling the exercise band to a carabiner; and coupling the carabiner to the attachment device.

19. The method of claim 16, wherein the coupling step comprises the step of tying the exercise band to the attachment device.

20. The method of claim 16, wherein the exercise band is elastic.

21. The method of claim 15, wherein the base has at least one upper support element and a plurality of posts, each of the posts coupled to the plurality of interconnected beams and to the at least one upper support element.

* * * * *